US006641966B2

(12) United States Patent
Endo et al.

(10) Patent No.: US 6,641,966 B2
(45) Date of Patent: Nov. 4, 2003

(54) TONER COMPOSITION

(75) Inventors: Akira Endo, Nagoya (JP); Mitsuru Ohta, Kani (JP); Hideo Ohira, Tajimi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/941,555

(22) Filed: Aug. 30, 2001

(65) Prior Publication Data

US 2002/0055054 A1 May 9, 2002

(30) Foreign Application Priority Data

Jan. 9, 2000 (JP) ..... 2000-265352

(51) Int. Cl.[7] ..... G03G 09/087

(52) U.S. Cl. ..... 430/109.1; 430/109.3; 430/111.4

(58) Field of Search ..... 430/109.1, 109.3, 430/111.4

(56) References Cited

U.S. PATENT DOCUMENTS

| | | | | |
|---|---|---|---|---|
| 5,670,287 A | * | 9/1997 | Kawata et al. | 430/106.6 |
| 6,054,239 A | * | 4/2000 | Ohira et al. | 430/111.41 |
| 6,326,119 B1 | * | 12/2001 | Hollenbaugh et al. | 430/137.2 |
| 2002/0081509 A1 | | 6/2002 | Yoshida et al. | |

FOREIGN PATENT DOCUMENTS

| | | |
|---|---|---|
| JP | 5-297630 | 11/1993 |
| JP | 6-67464 | 3/1994 |
| JP | 6-324515 | 11/1994 |
| JP | 7-325490 | 12/1995 |
| JP | 8-292600 | 11/1996 |
| JP | 9-6051 | 1/1997 |
| JP | 10-268564 | 10/1998 |
| JP | 10-282822 | 10/1998 |
| JP | 10-326029 | 12/1998 |
| JP | 11-24306 | 1/1999 |
| JP | 11-65164 | 3/1999 |
| JP | 11-72948 | 3/1999 |
| JP | 11-106494 | 4/1999 |
| JP | 11-125946 | 5/1999 |
| JP | 11-219057 | 8/1999 |
| JP | 11-249341 | 9/1999 |
| JP | 2000-187358 | 7/2000 |

* cited by examiner

*Primary Examiner*—John Goodrow
(74) *Attorney, Agent, or Firm*—Oliff & Berridge, PLC

(57) ABSTRACT

A toner composition having a high light transmission when printed on a transparent medium, in addition to being superior in strength and durability is provided. Binder resin particles manufactured through a dispersing polymerization method are colored using at least one kind of dye and are then subjected to a process of injecting an organic finely divided powder and a charge controlling agent and to a process of externally adding a hydrophobic silica and a conductive titanium oxide, thereby making a toner composition having a gel percentage of 2 to 15%.

27 Claims, 6 Drawing Sheets

MANUFACTURING PROCESSES OF DISPERSED AND POLYMERIZED TONER COMPOSITION $$T_t = T_d + T_s$$

TONER COMPOSITION

BACKGROUND OF THE INVENTION

1. Field of the Invention

The present invention relates to a toner composition used, for example, as dry toner for developing an electrostatic latent image.

2. Description of Related Art

A toner using a binder resin as the major component and containing a pigment, a charge controlling agent, an external additive or the like has conventionally been used as a toner for a printer employing an electrostatic latent image developing system.

For example, in a printer employing an electrostatic latent image developing system as shown in FIG. 7, this type of toner T may be fed off from a tank 1 by a supply roller 2. After a toner layer formed on a developing roller 3 is made uniform by a blade 7, the toner T is applied to the surface of a photoconductor 4.

The surface of the photoconductor 4 is charged so as to correspond to a certain image pattern by a laser scanner unit 5 and a corona unit 6, while the toner T is charged to a polarity opposite to that on the surface of the photoconductor 4. The toner T is therefore attracted onto a portion charged on the photoconductor 4, but not to portions which are not charged. Namely, the toner T is dispersed so as to correspond to the certain image pattern (charge pattern) on the surface of the photoconductor 4.

A medium 9 such as paper or the like is then pressed against the photoconductor 4 via an image transfer roller 8 so that the toner image may be transferred onto the medium 9. Heat is then applied to the toner T by a fusing roller 10 so that it is melted and fused on the surface of the medium, thus accomplishing printing of the image.

Because of such applications involved, toner is required of a strength (mechanical strength) and durability of a level sufficient to ensure that it is not crushed, or softened to stick to a roller or the photoconductor of the printer during a printing process.

It is often the case with toner, for the purpose of controlling the amount of charge of toner, that a charge controlling agent is treated and a substance such as hydrophobic silica or the like is externally added to the surface of toner. If the toner lacks in adequate strength, however, the charge controlling agent or the external additive could be embedded in toner, causing the toner to be charged insufficiently. As a result, the toner distribution pattern on the surface of the photoconductor does not accurately correspond to the charged pattern of the photoconductor, resulting in print quality being degraded.

As a solution to this problem, the degree of crosslinking of the binder resin that makes up toner has been enhanced and a gel percentage increased, thereby enhancing strength of toner.

When printing is done on a transparent medium such as OHP transparencies using toner having a color other than black (color toner), a layer made up of toner fused onto the surface of the transparent medium (a toner layer) is required to have a high light transmission.

The type of toner having a high gel percentage is, however, not melted sufficiently even when heat is applied thereto during a fusing process. As a result, the surface of the toner layer after the fusing process is irregularly shaped because an original shape of powder is left unchanged.

If such a type of toner is used to print on a transparent medium, the toner layer scatters rays of light because of its irregular surface shape, thus presenting a-problem of poor light transmission.

SUMMARY OF THE INVENTION

In view of the foregoing, it is therefore an object of the invention to provide a toner composition that offers a high light transmission when printing is done on a transparent medium, in addition to a superb strength and durability.

To achieve the foregoing object, a toner composition according to one aspect of the invention comprises at least one kind of binder resin and has a gel percentage of 2 to 15% and a flow-out starting temperature of 80 to 120° C.

Since the toner composition according to the invention has a gel percentage of 2% or more, it offers a sufficiently high strength and durability and is never crushed or softened to stick to a roller or a photoconductor of a printer during a print process.

Further, since the toner composition according to the invention has a gel percentage of 15% or less, it is difficult to become brittle and is less likely to crack during a print process.

In terms of preventing the toner composition from becoming brittle, it is even more preferable that the gel percentage be 8% or less.

In the case where the toner composition according to the invention is, for example, transferred to a medium and fused by applying heat thereto, the toner composition according to the invention is melted sufficiently thanks to a low flow-out starting temperature of 120° C. or lower thereof and a layer made up of the toner composition (a toner layer) formed on the surface of the medium after the fusing process has a smooth surface shape.

If printing is done on, for example, a transparent medium such as OHP transparencies or the like, using the toner composition according to the invention, therefore, the toner layer, because of smoothness of the flat surface involved therein, allows a large part of an incidence light to pass therethrough without allowing it to disperse, thus offering a high light transmission. The toner composition according to the invention is therefore superior as a color toner used with a transparent medium.

Since the flow-out starting temperature of the toner composition according to the invention is 80° C. or higher, toner melted during fusing can be prevented from sticking to a fusing roller. During any time other than fusing, the toner composition is not softened, making it easy to handle.

A gel percentage refers to a percentage of a portion that remains solid to that melted away of, for example, a solid substance (sample) which has been immersed in a certain solvent. Suppose, for example, A g of a sample is placed in a certain solvent (e.g., tetrahydrofuran) and we have B g left as solid without being dissolved. Then, B/A is the gel percentage.

The flow-out starting temperature refers to a temperature at which a solid substance is softened to start exhibiting fluidity.

For example, a solid substance-(sample) is placed in an apparatus (e.g., the flow tester recommended by the Society of Polymer Chemistry manufactured by Shimadzu Corporation) having a restricted outlet (e.g., a nozzle with an orifice diameter of 1 mm and a length of 10 mm) and capable of applying a predetermined load (e.g., 10 kg/cm$^2$) to the sample by means of a plunger; when the sample is heated at a constant rate (e.g., 6° C./min.) with the load kept applied thereto, the sample is eventually fluidized to start flowing out through the outlet, which, in turn, causes the plunger to start lowering. The temperature at which the plunger starts lowering may be considered as the flow-out starting temperature.

The toner composition according to the invention may contain components, for example, a dye, pigment, organic finely divided powder, charge controlling agents hydrophobic silica, conductive titanium oxide, and the like, in addition to the binder resin. It should be noted that more than two kinds of dye, pigment, organic finely divided powder, charge controlling agent, hydrophobic silica, conductive titanium oxide, and the likes may be used.

The hydrophobic silica and the conductive titanium oxide have the effect of, for example, improving fluidity of the toner composition or uniformity in charging, respectively.

Typical types of hydrophobic silica include silica subjected to surface treatment using dimethyldichlorosilane, dimethyl polysiloxane, hexamethyldisilazine, amino-silane, and amine. Commercially available silica products include, for example, H2000, H3004, HVK2150, and the like manufactured by Nippon Wacker Co., Ltd. and R974, RY200, RX200, RX300, RA200H, REA200, and the like manufactured by Nippon Aerosil Co., Ltd.

As the conductive titanium oxide, it is preferable that titanium oxide having undergone surface treatment using tin oxide-based semiconductor or indium oxide-based semiconductor be used. It is particularly preferable that the conductive titanium oxide have a resistance value of about 1 to 50 Ω·cm and a BET area/weight ratio of about 5 to 70 $m^2/g$. Example commercially available products include EC-100, EC-210, EC-300, and EC-500 manufactured by Titan Kogyo Kabushiki Kaisha.

A toner composition according to another aspect of the invention, contains at least one kind of binder resin and has a gel percentage of 2 to 15% and a ½-method temperature of 100 to 145° C.

Since the toner composition according to the invention has a gel percentage of 2% or more, it offers a sufficiently high strength and durability and is never crushed or softened to stick to a printer part during a print process.

Furthermore, since the toner composition according to the invention has a gel percentage of 15% or less (more preferably 8% or less), it does not become brittle and thus never cracks during a print process.

In addition, since the toner composition according to the invention has a ½-method temperature of 140° C. or less, it melts sufficiently well when subjected to a process of fixing it onto the surface of the medium and the surface of a toner layer after the fusing process is smooth.

When printing is done on, for example, a transparent medium such as OHP transparencies or the like, using the toner composition according to the invention, therefore, the toner layer exhibits a high light transmission thanks to smoothness of the flat surface involved therein.

The toner composition according to the invention is therefore superior as a color toner used with a transparent medium.

Since the ½-method temperature of the toner composition according to the invention is 100° C. or higher, toner melted during fusing can be prevented from sticking to a fusing roller. During any time other than fusing, the toner composition is not softened, making it easy to handle.

The ½-method temperature may be defined, for example, as follows.

A solid substance (sample) is placed in an apparatus (e.g. the type flow tester recommended by the society of Polymer Chemistry manufactured by Shimadzu Corporation) having a restricted outlet (e.g., a nozzle with an orifice diameter of 1 mm and a length of 10 mm) and capable of applying a predetermined load (e.g., 10 $kg/cm^2$) to the sample by means of a plunger; when the sample is heated at a constant rate (e.g., 6° C./min.) with the load kept applied thereto, the sample is eventually fluidized to start flowing out through the outlet.

This, in turn, causes the plunger to start lowering. When a graph is drawn with the amount of downward movement of the plunger taken on the vertical axis and the temperature taken on the horizontal axis, then an S-shaped curve will be drawn. If the height of the S-shaped curve (that is, the total amount of downward movement of the plunger between the time at which the sample starts flowing out and the time at which the sample stops flowing out) is h, the temperature at which the downward movement of the plunger becomes ½h may be defined as the ½-method temperature.

A toner composition according to still another aspect of the invention contains at least one kind of binder resin and has a gel percentage of 2 to 15%, a flow-out starting temperature of 80 to 120° C., and a ½-method temperature of 100 to 145° C.

Since the toner composition according to the invention has a gel percentage that ranges between 2 and 15% (more preferably between 2 and 8%), it offers a sufficiently high strength and durability and is never crushed or softened to stick to a printer part during a print process, like the toner compositions according to above-mentioned one aspect and another aspect of the invention.

Furthermore, since the toner composition according to the invention is not brittle and thus can never crack during a print process.

In addition, the toner composition according to the invention has a flow-out starting temperature of 120° C. or less and a ½-method temperature of 145° C. or less. Therefore, when printing is done on, for example, a transparent medium using the toner composition according to the invention, a toner layer formed has a smooth surface, exhibiting a high light transmission. The toner composition according to the invention is therefore excellent as a color toner used with a transparent medium.

Since the toner composition according to the invention has a flow-out starting temperature of 80° C. or more and a ½-method temperature of 100° C. or more, toner melted during fusing can be prevented from sticking to a fusing roller. During any time other than fusing in an entire print process, the toner composition is not melted, making it easy to handle.

Furthermore, the toner composition according to the invention may contain at least one kind of dye. Namely, the toner composition can be of many different colors depending on the color of the dye to be included therein. Since the toner composition according to the invention develops a color by means of the dye, it is superior in color development performance and a range of color reproduction to conventional toner compositions that develop colors with pigments.

In addition to being capable of developing various colors as described in the foregoing, the toner composition according to the invention is superior in light transmission when printing is done on a transparent medium, it is suitable for color printing on OHP transparencies.

Typical dyes to be used include a direct dye, acid dye, disperse dye, cationic dye, reactive dye, sulfur dye, oilsoluble dye, and a metallic complex dye. Particularly preferable are the disperse dye and the cationic dye.

To give an example of a method of manufacturing a toner composition containing a dye, as disclosed in Japanese Patent Application Laid-Open Publication No. BEI 10-326029, the dye and resin particles are dispersed in an aqueous solvent and the solvent is agitated, while being heated to a temperature that can range between a softening temperature of the resin particles and a temperature 40° C. higher than the softening temperature. After the resin particles are colored with the dye, they are subjected to reduction cleaning in order to remove excess dye that deposits on the surface of the resin particles. For a solvent used in this reduction cleaning, an aqueous solvent in which sodium hydrate or hydroxy sulfite is dissolved is to be used.

The toner composition according to the invention may be shaped in a spheres Namely, the toner composition has a high fluidity for its spherical shape and a low void ratio for a high bulk density thereof, minimizing heat loss during fusing.

The shape of the toner composition according to the invention may be represented by, for example, a sphericity (circularity) ranging between 1 and 0.95.

The sphericity (circularity) as the term used in this specification is one that, for example, is calculated through the following formula and the value is 1 if the shape is a true sphere. For measurement of sphericity, a flow type particle image analyzer FPIA-1000 manufactured by Sysmex may, for example, be used.

Sphericity (circularity)=L1/L2 where

L1: circumference of a circle having the same projection plane area as the particle image L2: Length of outline of the particle projected image The toner composition according to the invention is used as dry toner for electrostatic latent image developing.

Since the toner composition according to the invention has a sufficintly high strength and durability and is never crushed or softened to stick to a part inside a printer, making it right for dry toner for electrostatic latent image developing.

In the case where the toner composition according to the invention is used by injecting a charge controlling agent in a surface thereof in order to increase the amount of charge, the charge controlling agent and an externally added substance could never be embedded inside the toner composition for a high strength and durability thereof even when the composition is subjected to an external force repeatedly (e.g., a pressure applied by a printer roller and photoconductor) during a print process, which prevents the amount of charge of the toner composition from being decreased.

It therefore follows that, even after a continuous print cycle for printing a plurality of pages (that is, even after the toner composition has been subjected to a repeated external force inside the printer), there is no chance of the toner composition decreasing the amount of charge thereof. This results in, for example, the charge being distributed in a manner that it corresponds accurately to the distribution of charge on the surface of the photoconductor of the printer, enabling high-quality printing.

An organic finely divided powder and a charge controlling agent may be added to the toner composition according to the invention in order to make it easy to charge. As a method of applying such a substance, the resin particles, and the organic finely divided powder and charge controlling agent are mixed together by means of a mechanical impact force, thereby injecting the organic finely divided powder and charge controlling agent into the surface of the resin particles, as disclosed, for example, in Japanese Patent Application Laid-Open Publication No. HEI 11-65164.

Typical organic finely divided powders added to achieve the foregoing purpose include an acrylic resin finely divided powder, a fluorinated resin finely divided powder, a silicone resin finely divided powder, and a melamine resin finely divided powder.

Typical charge controlling agents include a metallic azo compound, a salicylic metal complex, a nigrosine, a triphenylmethane, and grade 4 ammonium salt.

The toner composition according to the invention is manufactured using a dispersion polymerization method that makes particles comprising at least one kind of binder resin. namely, since the binder resin particle made using the dispersion polymerization method has a small average particle diameter and a narrow particle diameter distribution, the toner composition according to the invention can have a small particle diameter and a narrow particle diameter distribution. Use of the toner composition according to-the invention-therefore makes printing of high image quality possible.

The dispersion polymerization method refers, for example, to the following. Namely, a monomer, a dispersing agent, initiator, and the like are loaded in a solvent and, when the solvent is set into a predetermined condition (e.g., a predetermined temperature), the initiator is made into a radical by which the monomer is polymerized to produce polymerized particles. At this time, a spot at which polymerization takes place is uniformly distributed throughout the solvent and a polymerization rate is constant regardless of the spot of polymerization thanks to an effect of the dispersing agent, which ensures that a large number of spherical polymerized particles of a uniform size are produced.

With the toner composition according to the invention, the toner layer formed when the toner composition is printed solidly and fused on a transparent medium has a gloss value of 30 or more and a surface roughness Rtm of 5 $\mu$m or less, In the case where the toner composition according to the invention is used on, for example, a printer employing the electrostatic latent image developing system to form a toner layer through printing solidly on a transparent medium, such toner layer has a gloss value of 30 or more and a surf ace roughness Rtm of 5 $\mu$m or less, which means that a surface thereof offers a high smoothness.

Therefore, the toner layer formed by the toner composition according to the invention lets, for a high smoothness offered by a surface thereof, a large part of an incidence light pass therethrough without allowing it to disperse, thus offering an outstanding light transmission.

That is, since the toner composition according to the invention is capable of forming a toner layer offering a high light transmission on a transparent medium, it is good as a color toner used on the transparent medium. A typical transparent medium is OHP transparencies.

The gloss value is an index indicating a smoothness of a sample surface. Referring to FIG. 5, if the amount of light striking the sample is Io and the amount of light reflecting off the sample is II, then the gloss value is given by the following equations The higher the smoothness of the sample surface, the smaller the amount of light being dispersed and the higher the gloss value.

$$\text{Gloss value } (\%)=(II/Io)\times 100$$

Solid printing refers to the following. With 256 gradation levels, for example, 16 grids each are theoretically arranged in a horizontal direction and a vertical direction, a total of 256 grids. Solid printing refers to printing on a mediium, in which a dot made up of the toner composition is present in each of all 256 grids. For example, in a 1,200-dpi, 256-gradation-level printer, one dot measures 21.2 μm and one pixel measures about 339.2 μm by 339.2 μm.

The above and further objects and novel features of the invention will more fully appear from following detailed description when the same is read in connection with the accompanying drawings. It is to be expressly understood, however, that the drawings are for the purpose of illustration only and not intended as a definition of the limits of the invention.

DETAILED DESCRIPTION OF THE EMBODIMENTS

Figure 1:
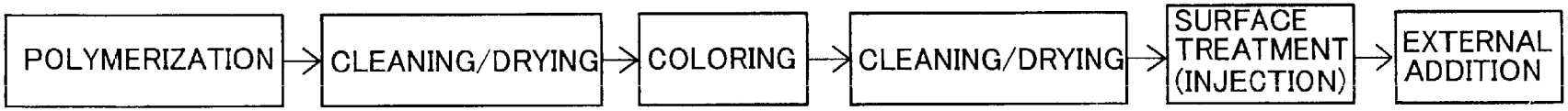
FIG. 1 is an explanatory drawing showing manufacturing processes of the toner composition.

Preferred examples of the toner composition according to the invention will be explained in details.

a) Manufacturing methods of toner compositions for examples 1 through 5 and comparative examples 1 through 5 will be explained. Manufacturing of a toner composition follows the steps of polymerization, cleaning and drying, coloring, cleaning and drying, surface treatment (injection), and external addition as shown in FIG. 1.

EXAMPLE 1

A toner composition A was manufactured by following steps <1> through <4> in the following:

<1> Manufacture of polymerized resin particles A (polymerization and cleaning/drying)

Polymerized resin particles A were manufactured using the dispersion polymerization method. More specifically, the following methods were used.

Methanol and isopropyl alcohol as solvents, polyvinyl pyrrolidone as a dispersing agent, styrene and acrylic acid n-buty, as monomers, and 2,2'-azobisisobutyronitrile as an initiator were loaded in a reaction apparatus fitted with an agitator, a cooling tube, a thermometer, and a gas inlet tube, while purging nitrogen gas through the gas inlet tube and, the reaction solution was heated to 60° C. and agitated at 100 rpm to carry out polymerization for 15 hours. Table 1 lists the part by weight of each of the compositions at loading.

Next, 0.5 parts by weight of vinyl biphenyl were added and polymerization was carried out for another 3 hours.

The solution was thereafter cooled to stop polymerization reaction. Polymerized resin particles obtained were recovered through filtering and cleaned using a water-methanol mixture. They were then left to stand to dry for 48 hours under room temperature to obtain polymerized resin particles A.

<2> Coloring and cleaning/drying 100 parts by weight of ion-exchange water, 100 parts by weight of polymerized resin particles A manufactured in step <1>, and 20 parts by weight of Kayalon Polyester Light Yellow 5G-S (manufactured by Nippon Kayaku Co., Ltd.) as a dye were loaded in the apparatus fitted with the agitator, the cooling tube, and the thermometer. The mixture was heated to 95° C. and agitated at 150 rpm for 1 hour. Colored particles were then recovered through filtering and, to remove excess dyes left on the surface of the colored particles, a reduction cleaning was carried out using a mixture of 100 parts by weight of ion-exchange water, 0.8 parts by weight of hydrosulfite, and 0.8 parts by weight of sodium hydrate. The colored particles were then left to stand to dry under room temperature for 48 hours to eventually obtain particles A colored in yellow.

<3> Treatment

Using a hybridization system model NSH-O built by Nara Machinery Co., Ltd., 0.3 parts by weight of organic finely divided powder N-70 (manufactured by Nippon Paint Co., Ltd.) and 1 part by weight of a charge controlling agent Bontron E-84 (manufactured by Hodogaya Chemical Co., Ltd. ) were treated into 100 parts by weight of particles A colored in yellow obtained in step <2> under conditions of a rotating speed of 130 rpm and a processing time of 5 minutes.

As a result, a treated sample A, which was the particles A colored in yellow, the surface of which was coated with the organic finely divided powder and the charge controlling agent, was obtained.

<4> External Taddition

Using Mechanomil manufactured by Okada Seiko Co., Ltd., 1 part by weight of hydrophobic silica H2000 (manufactured by Nippon Wacker Co., Ltd.) and 1 part by weight of titanium oxide EC-300 (manufactured by Titan Kogyo Kabushiki Kaisha) were externally added to 100 parts by weight of the treated sample A obtained in step <3> under conditions of a rotating speed of 2,750 rpm and a processing time of 3 minutes to eventually obtain the toner composition A.

EXAMPLE 2

A toner composition B was manufactured by following steps <1> through <4> in the following:

<1> Manufacture of polymerized resin particles B (polymerization and cleaning/drying)

Polymerized resin particles B were manufactured using the dispersion polymerization method. More specifically, the following methods were used.

Ethanol and distilled water as solvents, polyvinyl pyrrolidone as a dispersing agent, styrene and acrylic acid n-butyl as monomers, and 2,2'-azobisisobutyronitrile as an initiator were loaded in a reaction apparatus equipped in the same manner as that used in step <1> of Example 1, and the reaction solution was heated to 60° C. and agitated at 100 rpm to carry out polymerization for 15 hours. Table 1 lists the part by weight of each of the compositions at loading.

Next, 0.5 parts by weight of divinylbenzene were added and polymerization was carried out for another 3 hours.

Thereafter, following the same-steps as in Example 1, the solution was cooled to stop polymerization reaction; the polymerized resin particles obtained were recovered through filtering and cleaned using a water-methanol mixture; they were then left to stand to dry for 48 hours under room temperature to obtain polymerized resin particles B.

<2> Coloring and cleaning/drying

Except that Kayalon Polyester Red HL-SF (manufactured by Nippon Kayaku Co., Ltd.) was used as the dye, particles B colored in magenta were obtained by following the same processes of coloring, cleaning, and drying as in step <2> of Example 1.

<3> Treatment

A treated sample B was obtained through the same treatment process as in step <3> of Example 1.

<4> External addition

The toner composition B was obtained through the same external addition process as in step <4> of Example 1.

EXAMPLE 3

A toner composition C was manufactured by following steps <1> through <4> in the following;

<1> Manufacture of polymerized resin particles C. (polymerization and cleaning/drying)

Polymerized resin particles C were manufactured using the dispersion polymerization method. More specifically, the following methods were used.

Methanol and isopropyl alcohol as solvents, polyvinyl pyrrolidone as a dispersing agent, styrene and acrylic acid n-butyl as monomers, 1,7-octa diene as a crosslinking agent, and 2,2'-azobisisobutyronitrile as an initiator were loaded in a reaction apparatus equipped in the same manner as that used in step <1> of Example 1, and the reaction solution was heated to 60° C. and agitated at 100 rpm to carry out polymerization for 18 hours. Table 1 lists the part by weight of each of the compositions at loading.

Thereafter, following the same steps as in Example 1, the solution was cooled to stop polymerization reaction; the polymerized resin particles obtained were recovered through filtering and cleaned using a water-methanol mixture; they were then left to stand to dry for 48 hours under room temperature to obtain polymerized resin particles C.

<2> Coloring and cleaning/drying

Except that Xayalon Polyester Red HL-SF (manufactured by Nippon Kayaku Co., Ltd.) was used as the dye, particles C colored in magenta were obtained by following the same processes of coloring, cleaning, and drying as in step <2> of Example 1.

<3> Treatment

A treated sample C was obtained through the same treatment process as in step <3> of Example 1.

<4> External addition

The toner composition C was obtained through the same external addition process as in step <4> of Example 1.

EXAMPLE 4

A toner composition D was manufactured by following steps <1> through <4> in the following:

<1> Manufacture of polymerized-resin particles D (polymerization and cleaning/drying)

Polymerized resin particles D were manufactured using the dispersion polymerization method. More specifically, the following methods were used.

Methanol and isopropyl alcohol as solvents, polyvinyl pyrrolidone as a dispersing agent, styrene and acrylic acid n-butyl as monomers, and 2,2'-azobisisobutyronitrile as an initiator were loaded in a reaction apparatus equipped in the same manner as that used in step <1> of Example 1, and the reaction solution was heated to 60° C. and agitated at 100 rpm to carry out polymerization for 15 hours. Table 1 lists the part by weight of each of the compositions at loading.

Next, 0.5 parts by weight of divinyl biphenyl were added and polymerization was carried out for another 3 hours.

Thereafter, following the same steps as in Example 1, the solution was cooled to stop polymerization reaction; the polymerized resin particles obtained were recovered through filtering and cleaned using a water-methanol mixture; they were then left to stand to dry for 48 hours under room temperature to obtain polymerized resin particles D.

<2> Coloring and cleaning/drying

Particles D colored in yellow were obtained by following the same processes of coloring, cleaning, and drying as in step <2> of Example 1.

<3> Treatment

A treated sample D was obtained through the same treatment process as in step <3> of Example 1.

<4> External addition

The toner composition D was obtained through the same external addition process as in step <4> of Example 1.

EXAMPLE 5

A toner composition B was manufactured by following steps <1> through <4> in the following:

<1> Manufacture of polymerized resin particles E (polymerization and cleaning/drying)

Polymerized resin particles E were manufactured using the dispersion polymerization method. More specifically, the following methods were used.

Methanol and isopropyl alcohol as solvents, polyvinyl pyrrolidone as a dispersing agent, styrene and acrylic acid n-butyl as monomers, and 2,2'-azobisisobutyronitrile as an initiator were loaded in a reaction apparatus equipped in the same manner as that used in step <1> of Example 1, and the reaction solution was heated to 60° C. and agitated at 100 rpm to carry out polymerization for 15 hours. Table 1 lists the part by weight of each of the compositions at loading.

Next, 0.1 parts by weight of divinylbenzene were added and polymerization was carried out for another 3 hours.

Thereafter, following the same steps as in Example 1, the solution was cooled to stop polymerization reaction; the polymerized resin particles obtained were recovered through filtering and cleaned using a water-methanol mixture; they were then left to stand to dry for 48 hours under room temperature to obtain olyterized resin particles E.

<2> Coloring and cleaning/drying

Except that Kayalon Polyester Red HL-SF (manufactured by Nippon Kayaku Co., Ltd.) was used as the dye, particles E colored in magenta were obtained by following the same processes of coloring, cleaning, and drying as in step <2> of Example 1.

<3> Treatment

A treated sample E was obtained through the same treatment process as in step <3> of Example 1.

<4> External addition

The toner composition E was obtained through the same external addition process as in step <4> of Example 1.

TABLE 1

| | Example 1 *(A) | Example 2 *(B) | Example 3 *(C) | Example 4 *(D) | Example 5 *(E) |
|---|---|---|---|---|---|
| Loading Compositions | | | | | |
| Methanol | 204 | | 233 | 204 | 262 |
| Ethanol | | 276 | | | |
| Isopropyl alcohol | 87 | | 58 | 87 | 29 |
| Distilled water | | 15 | | | |
| Polyvinyl pyrrolidone K-25 | | 6 | 6 | | 6 |
| Polyvinyl pyrrolidone K-30 | 6 | | | 6 | |
| Styrene | 77 | 80 | 77 | 77 | 77 |
| Acrylic acid n-butyl | 23 | 20 | 23 | 23 | 23 |
| 1,7-octa diene | | | 0.5 | | |
| 2,2'-azobisisobutyronitrile | 3 | 3 | 3 | 3 | 3 |
| Later Addition | | | | | |
| Vinyl biphenyl | 0.5 | | | | |
| Divinyl biphenyl | | | | 0.5 | |
| Divinylbenzene | | 0.5 | | | 0.1 |

*Examples 1, 2, 3, 4, and 5 correspond to toner composition A, B, C, D, and E, respectively.

Comparative Example 1

A toner composition F was manufactured by following steps <1> through <4> in the following:

<1> Manufacture of polymerized resin particles F (polymerization and cleaning/drying)

Polymerized resin particles F were manufactured using the dispersion polymerization method. More specifically, the following methods were used.

Methanol and isopropyl alcohol as solvents, polyvinyl pyrrolidone as a dispersing agent, styrene and acrylic acid n-butyl as monomers, and 2,2,'-azobisisobutyronitrile as an initiator were loaded in a reaction apparatus equipped in the same manner as that used in step <1> of Example 1, and the reaction solution was heated to 60° C. and agitated at 100 rpm to carry out polymerization for 15 hours. Table 2 lists the part by weight of each of the compositions at loading.

Next, 2 parts by weight of divinylbenzene were added and polymerization was carried out for another 3 hours.

Thereafter, following the same steps as in Example 1, the solution was cooled to stop polymerization reaction; the polymerized resin particles obtained were recovered through filtering and cleaned using a water-methanol mixture; they were then left to stand to dry for 48 hours under room temperature to obtain polymerized resin particles F.

<2> Coloring and cleaning/drying

Particles E colored in yellow were obtained by following the same processes of coloring, cleaning, and drying as in step <2> of Example 1.

<3> Treatment

A treated sample F was obtained through the same treatment process as in step <3> of Example 1.

<4> External addition

The toner composition F was obtained through the same external addition process as in step <4> of Example 1.

Comparative Example 2

A toner composition G was manufactured by following steps <1> through <4> in the following:

<1> Manufacture of polymerized resin particles G (polymerization and cleaning/drying)

Polymerized resin particles G were manufactured using the dispersion polymerization method. More specifically, the following methods were used.

Methanol and isopropyl alcohol as solvents, polyvinyl pyrrolidone as a dispersing agent, styrene and acrylic acid n-butyl as monomers, and 2,2'-azobisisobutyronitrile as an initiator were loaded in a reaction apparatus equipped in the same manner as that used in step <1> of Example 1, and the reaction solution was heated to 60° C. and agitated at 100 rpm to carry out polymerization for 15 hours Table 2 lists the part by weight of each of the compositions at loading.

Next, 0.5 parts by weight of divinylbenzene were added and polymerization was carried out for another 3 hours.

Thereafter, following the same steps as in Example 1, the solution was cooled to stop polymerization reaction; the polymerized resin particles obtained were recovered through filtering and cleaned using a water-methanol mixture; they were then left to stand to dry for 48 hours under room temperature to obtain polymerized resin particles G.

<2> Coloring and cleaning/drying

Except that DIANIX Turq. BN-FS 200% (manufactured by Dyestar Japan) was used as the dye, particles a colored in cyan were obtained by following the same processes of coloring, cleaning, and drying as in step <2> of Example 1.

<3> Treatment

A treated sample G was obtained through the same treatment process as in step <3> of Example 1.

<4> External addition

The toner composition G was obtained through the same external addition process as in step <4> of Example 1.

Comparative Example 3

A toner composition H was manufactured by following steps <1> through <4> in the following:

<1> Manufacture of polymerized resin particles H (polymerization and cleaning/drying)

Polymerized resin particles H were manufactured using the dispersion polymerization method, More specifically, the following methods were used.

Methanol and isopropyl alcohol as solvents, polyvinyl pyrrolidone as a dispersing agent, styrene and acrylic acid n-butyl as monomers, and 2,2'-azobisisobutyronitrile as an initiator were loaded in a reaction apparatus equipped in the same manner as that used in step <1> of Example 1, and the reaction solution was heated to 60° C. and agitated at 100 rpm to carry out polymerization for 15 hours. Table 2 lists the part by weight of each of the compositions at loading.

Next, 1 part by weight of divinylbenzene were added and polymerization was carried out for another 3 hours.

Thereafter, following the same steps as in Example 1, the solution was cooled to stop polymerization reaction; the polymerized resin particles obtained were recovered through filtering and cleaned using a water-methanol mixture; they were then left to stand to dry for 48 hours under room temperature to obtain polymerized resin particles H.

<2> coloring and cleaning/drying

Particles H colored in yellow were obtained by following the same processes of coloring, cleaning, and drying as in step <2> of Example 1.

<3> Treatment

A treated sample H was obtained through the same treatment process as in step <3> of Example 1.

<4> External addition

The toner composition H was obtained through the same external addition process as in step <4> of Example 1.

Comparative Example 4

A toner composition I was manufactured by following steps <1> through <4> in the following:

<1> Manufacture of polymerized resin particles I (polymerization and cleaning/drying)

Polymerized resin particles I were manufactured using the dispersion polymerization method. More specifically, the following methods were used.

Methanol and isopropyl alcohol as solvents, polyvinyl pyrrolidone as a dispersing agent, styrene and acrylic acid n-butyl as monomers, and 2,2'-azobisisobutyronitrile as an initiator were loaded in a reaction apparatus equipped in the same manner as that used in step <1> of Example 1, and the reaction solution was heated to 60° C. and agitated at 100 rpm to carry out polymerization for 15 hours. Table 2 lists the part by weight of each of the compositions at loading.

Next, 0.5 parts by weight of divinylbenzene were added and polymerization was carried out for another 3 hours.

Thereafter, following the same steps as in Example 1, the solution was cooled to stop polymerization reaction; the polymerized resin particles obtained were recovered through filtering and cleaned using a water-methanol mixture; they were then left to stand to dry for 48 hours under room temperature to obtain polymerized resin particles I.

<2> Coloring and cleaning/drying

Except that Kayalon Polyester Red BL-SF (manufactured by Nippon Kayaku Co., Ltd.) was used as the dye, particles I colored in magenta were obtained by following the same processes of coloring, cleaning, and drying as in step <2> of Example 1.

<3> Treatment

A treated sample I was obtained through the same treatment process as in step <3> of Example 1.

<4> External addition

The toner composition I was obtained through the same external addition process as in step <4> of Example 1.

Comparative Example 5

A toner composition J was manufactured by following steps <1> through <4> in the following:

<1> Manufacture of polymerized resin particles J (polymerization and cleaning/drying)

Polymerized resin particles J were manufactured using the dispersion polymerization method. More specifically, the following methods were used.

Methanol and isopropyl alcohol as solvents, polyvinyl pyrrolidone as a dispersing agent, styrene and acrylic acid n-butyl as monomers, and 2,2'-azobisisobutyronitrile as an initiator were loaded in a reaction apparatus equipped in the same manner as that used in step <1> of Example 1, and the reaction solution was heated to 60° C. and agitated at 100 rpm to carry out polymerization for 18 hours. Table 2 lists the part by weight of each of the compositions at loading.

Thereafter, following the same steps as in Example 1, the solution was cooled to stop polymerization reaction; the polymerized resin particles obtained were recovered through filtering and cleaned using a water-methanol mixture; they were then left to stand to dry for 48 hours under room temperature to obtain polymerized resin particles J.

<2> Coloring and cleaning/drying

Except that Kayalon Polyester Red HL-SF (manufactured by Nippon Kaytaku Co., Ltd.) was used as the dye, particles J colored in magenta were obtained by following the same processes of coloring, cleaning, and drying as in step <2> of Example 1.

<3> Treatment

A treated sample J was obtained through the same treatment process as in step <3> of Example 1.

<4> External addition

The toner composition J was obtained through the same external addition process as in step <4> of Example 1.

TABLE 2

| | Comparative Example 1 *(F) | Comparative Example 2 *(G) | Comparative Example 3 *(H) | Comparative Example 4 *(I) | Comparative Example 5 *(J) |
|---|---|---|---|---|---|
| Loading Compositions | | | | | |
| Methanol | 233 | 204 | 204 | 175 | 204 |
| Ethanol | | | | | |
| Isopropyl alcohol | 58 | 87 | 87 | 116 | 87 |
| Distilled water | | | | | |
| Polyvinyl pyrrolidone K-25 | | 6 | | 6 | |
| Polyvinyl pyrrolidone K-30 | 12 | | 6 | | 6 |
| Styrene | 77 | 77 | 77 | 83 | 77 |
| Acrylic acid n-butyl | 23 | 23 | 23 | 17 | 23 |
| 1,7-octa diene | | | | | |
| 2,2'-azobisisobutyronitrile | 6 | 3 | 3 | 3 | 3 |
| Later Addition | | | | | |
| Vinyl biphenyl | | | | | |
| Divinyl biphenyl | | | | | |
| Divinylbenzene | 2 | 0.5 | 1 | 0.5 | |

*Comparative Examples 1, 2, 3, 4, and 5 correspond to toner composition F, G, H, I, and J, respectively.

b) The average particle diameter and gel percentage of toner compositions A to J were then measured.

<1> Measurement method for average particle diameter

Model Coulter Multisizer II built by Coulter was used as the measuring machine. As Measurement conditions, the diameter of the aperture was adjusted to 50 μm and the concentration of the sample was adjusted to about 50,000 counts per 20 second.

<2> Measurement method for gel percentage

A quantity of 0.01 g of the toner composition and of 50 ml of tetrahydrofuran were weighed and loaded in a 50-ml Erlenmeyer flask with ground stopper. The flask was then agitated for about 3 hours to allow the toner composition to dissolve.

The solution of tetrahydrofuran in which the toner composition was dissolved is then filtered through a membrane filter (PTFE, trapping particle diameter 0.5 μm: made by ADVANTEC.

The used filter was dried and, using weight A of the used filter, weight B of a new membrane filter, and the following equation, gel percentage was calculated.

$$\text{Gel percentage } (\%)=\{(A-B)/0.01\}\times 100$$

<3> Measurement results

Results of the measurement are shown in Table 3.

TABLE 3

| Toner Composition | Average Particle Diameter (μm) | Gel Percentage (%) |
|---|---|---|
| A (Example 1) | 7.5 | 4.7 |
| B (Example 2) | 5.6 | 4.6 |
| C (Example 3) | 10.0 | 3.6 |
| D (Example 4) | 7.6 | 2.7 |
| E (Example 5) | 6.9 | 2.6 |
| F (Comparative Example 1) | 6.9 | 24.3 |
| G (Comparative Example 2) | 10.1 | 9.7 |
| H (Comparative Example 3) | 8.8 | 8.7 |
| I (Comparative Example 4) | 7.2 | 7.6 |
| J (Comparative Example 5) | 7.8 | 0 |

c) Characteristics of toner compositions A to J were then evaluated. Evaluation items were the flow-out starting temperature, ½-method temperature, gloss value of the toner layer in solid printing on OHP transparencies (transparent medium), surface roughness Atm, haze value, and changes in fog value during durability printing.

Figure 2:
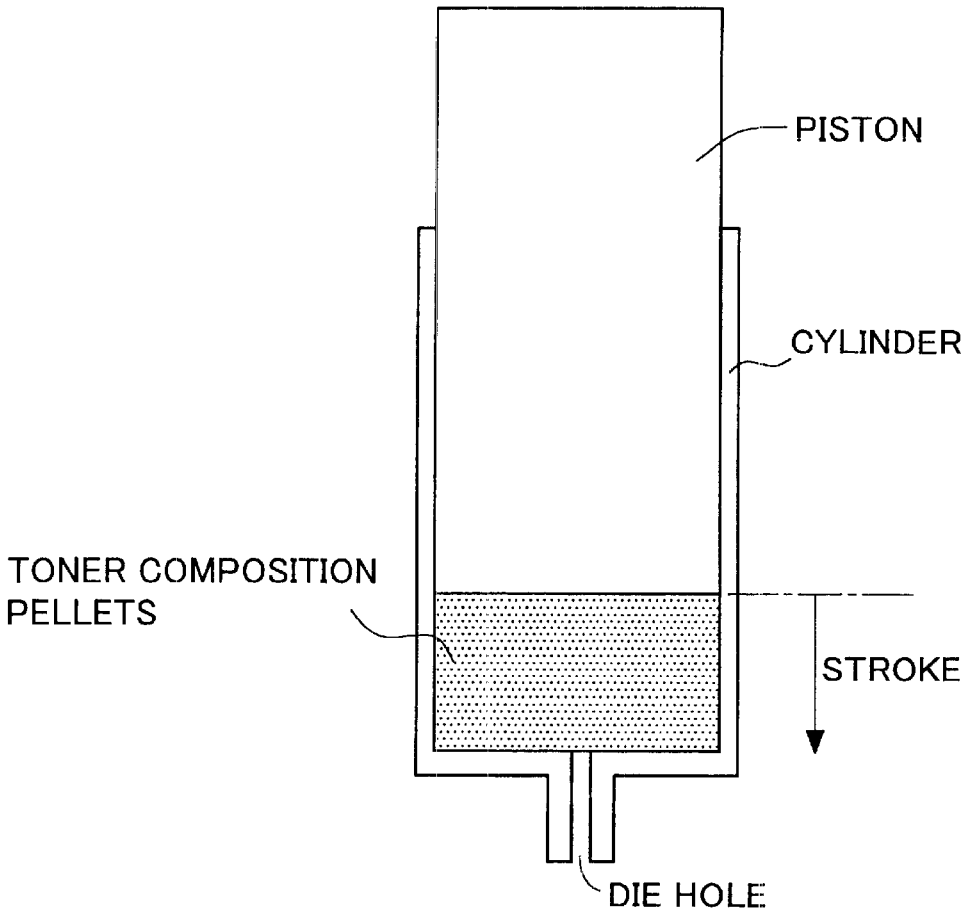
FIG. 2 is an explanatory drawing showing a measurement method for the flow-out starting temperature and the ½-method temperature.
Figure 3:
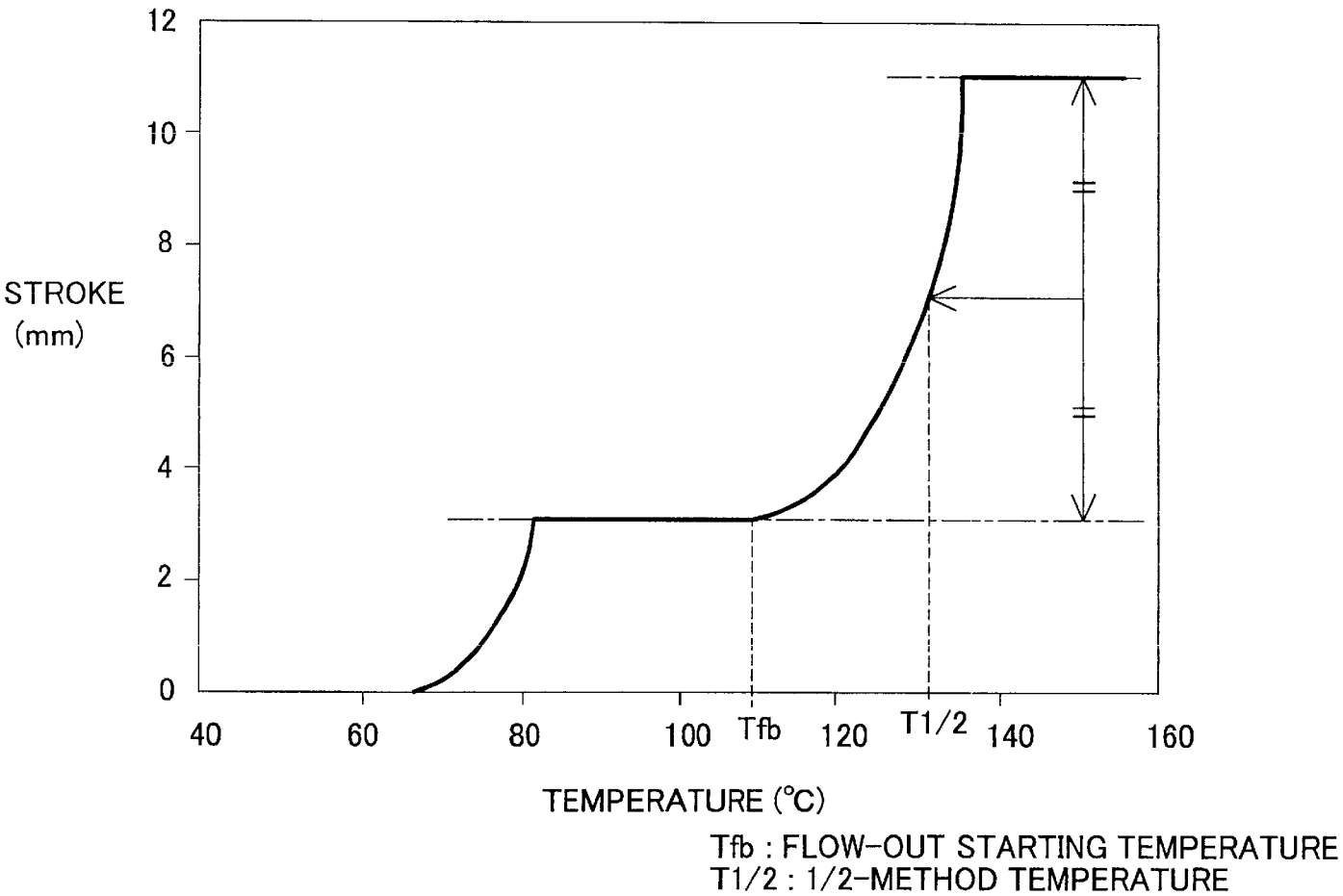
FIG. 3 is an explanatory drawing showing the flow-out starting temperature and the ½-method temperature.
Figure 4:
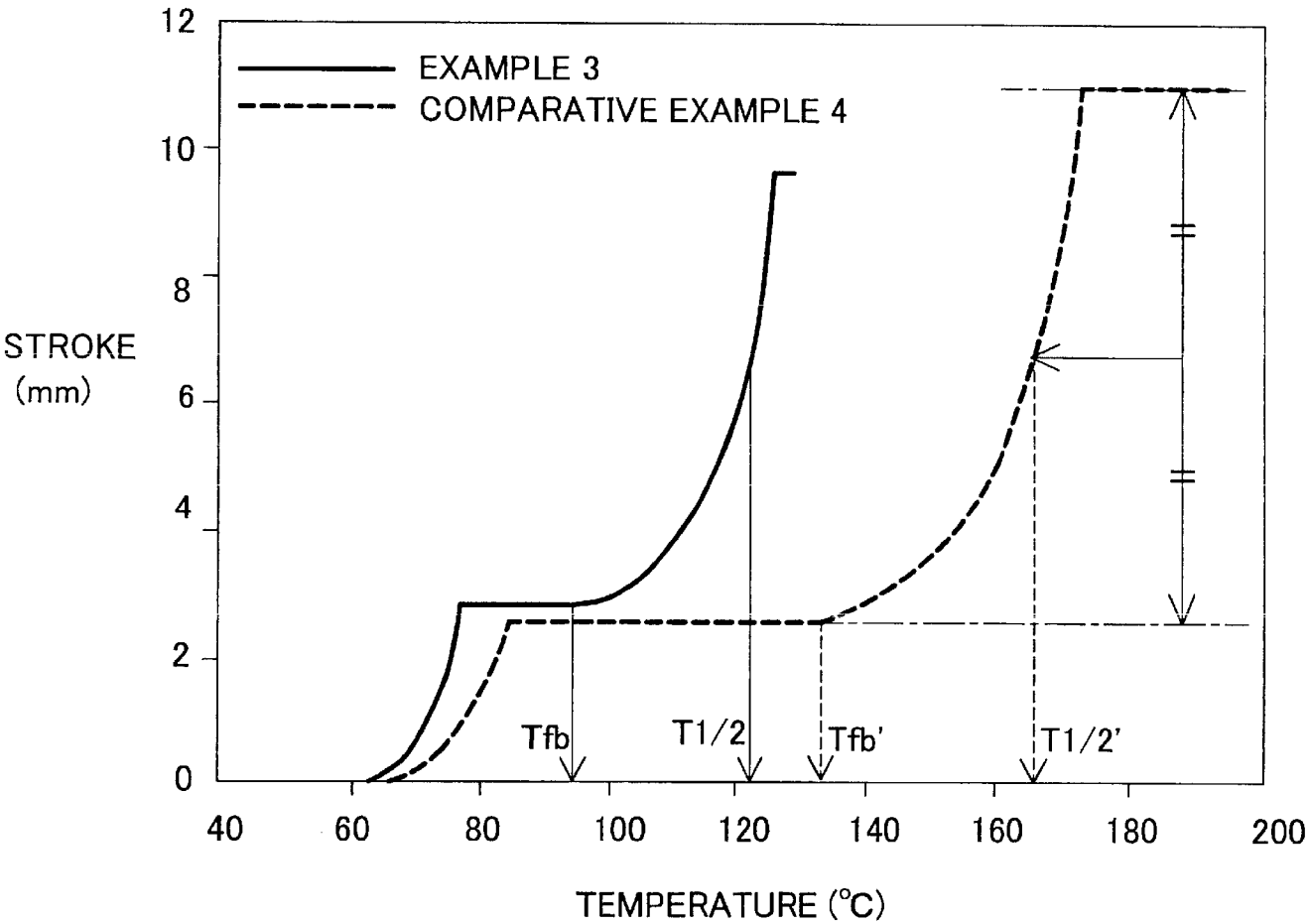
FIG. 4 is an explanatory drawing showing the flow-out starting temperature and the ½-method temperature.

<1> Evaluation method for the flow-out starting temperature and ½-method temperature The theory of measurement is given in the following. Referring to FIG. 2, pellets of the toner composition are loaded in a cylinder having a die hole in a bottom thereof and a predetermined load is applied from the above downward using a piston. When the toner composition is heated at a constant rate, it gradually softens and eventually flows out through the die hole. The relationship between the stroke of the piston (a downward stroke of the piston) and the temperature of the toner composition is depicted in FIGS. 3 and 4. Referring to FIGS. 3 and 4, the temperature at which the stroke begins to increase (that is, the toner composition starts flowing out) is the flow-out starting temperature and the temperature at which the stroke is at the center of a width of variations thereof (that is, half of the toner composition has flown out) is the ½-method temperature.

Model CFT-500C flow tester built by Shimadzu Corporation was used as the measuring machine. The measurement conditions are as follows.

Starting temperature: 40° C.; Final temperature; 300° C.

Heating rate: 6.0° C./min.; Measurement intervals: Every 3.0° C.

Preheat time: 60 sec.; Test load: 10 kgf/cm$^2$

Die hole diameter: 1 mm;. Die length: 10 mm

Sample volume: Approx. 1.1 g

<2> Measurement method for gloss value

Figure 5:
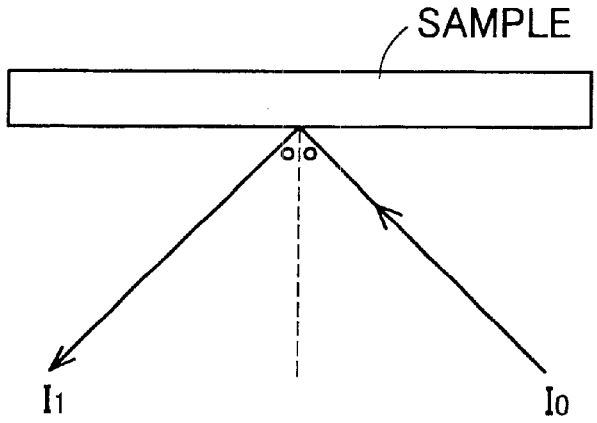
FIG. 5 is an explanatory drawing showing the gloss value.

Gloss value is an index indicating smoothness of the surface of a sample. It is given by the following equation assuming that the amount of light striking the sample is Io and the amount of light reflected off the sample is II as shown in FIG. 5.

$$\text{Gloss value } (\%) = (II/Io) \times 100$$

Specific methods used for the measurement will be explained.

As a measurement sample, a solid patch was produced through solid printing to form a toner layer of each of the different toner compositions on a sheet of OHP transparencies.

To produce the solid patches, model MICROLINE 600CL page printer manufactured by Oki Data Systems Co., Ltd. (a laser printer capable of producing 6 printed pages per minute; modified to demount the fusing unit therefrom), in which model SL SIGMA (manufactured by Hitachi) offline fusing unit was mounted, was used. The offline fusing unit employs rollers that press a sheet of OHP transparencies being transported at a predetermined speed, while at the same time, heating it, thereby fixing the toner composition onto the surface of the ORP transparencies. Specific fusing conditions used are as follows.

Fusing temperature; 130 to 200° C.

Fusing speed (ORP transparencies feeding speed): 10 to 30 mm/sec.

Nip width: 4 mm

Fusing pressure: 126,000 Pa

Roller material: Silicone rubber

Color Laser OHP Transparencies TR-1 (manufactured by Canon Inc.) was used for the OHP transparencies.

Multi-light-source spectrophotometer model MSC-2 and digital angle glossmeter model UGV-5K manufactured by Suga Test Instruments were then used to measure the amount of incidence light Io and the amount of reflected light II and the measured values were substituted for the corresponding terms of the aforementioned equation to find a gloss value. The angle of reception and the angle of incidence were set to 60°.

<3> Measurement method for surface roughness Rtm

The toner layer produced on a sheet of OHP transparencies in <2> described above was used as the sample and surface roughness Rtm thereof was measured using surface roughness measuring machine model Surtronic 10 manufactured by Taylor-Hobson.

<4> Haze value

Figure 6:
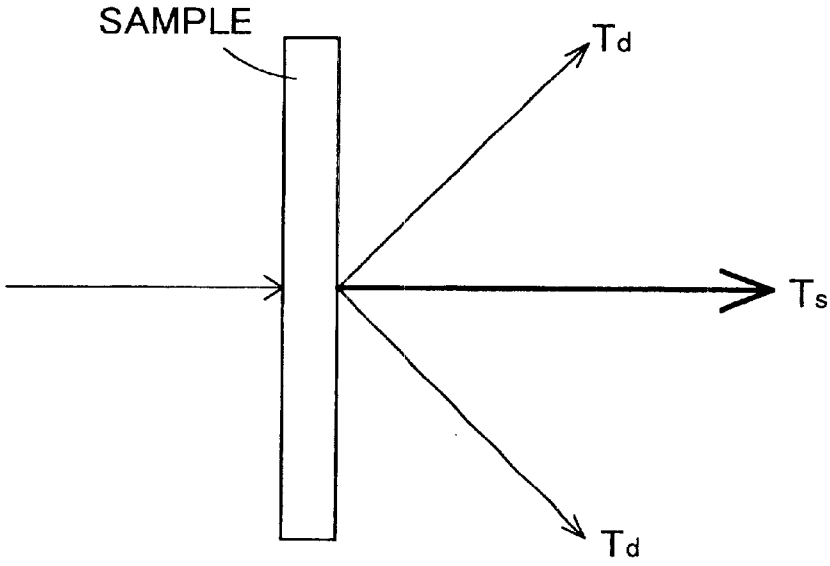
FIG. 6 is an explanatory drawing showing the haze value.
Figure 7:
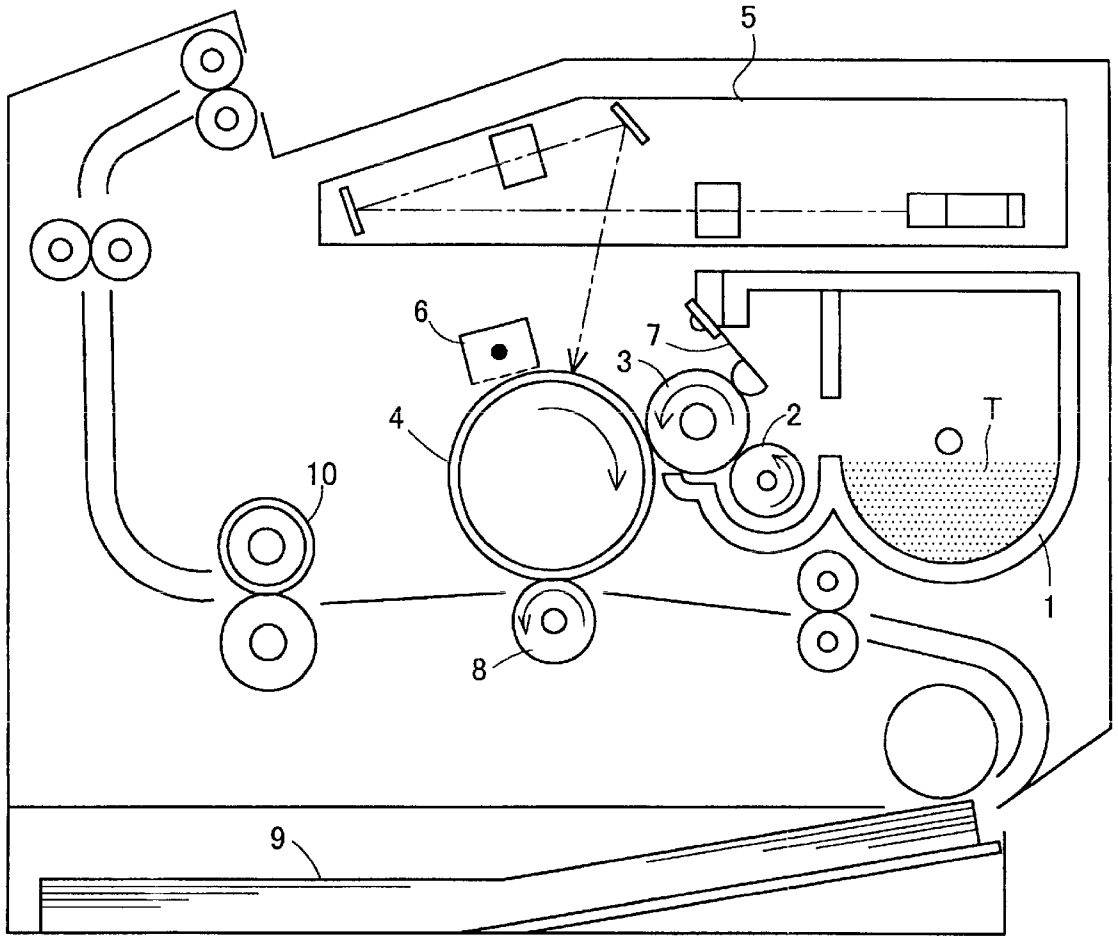
FIG. 7 is an explanatory drawing showing a printer employing an electrostatic latent image developing system.

Haze value is an index that indicates the degree with which rays of light diffuse of all that has traveled through a transparent sample. Referring to FIG. 6, if the amount of transmitted light diffused is Td and the total amount of transmitted light is Tt, the haze value is given by the following equation.

$$\text{Haze value } (\%) = (Td/Tt) \times 100$$

The smaller the haze value, therefore, the smaller the amount of transmitted light diffused, indicating that the transparency of the sample is high.

The specific measurement method used will be explained.

The toner layer produced on a sheet of OnP transparencies in <2> described above was used as the sample and model EGM-2DP direct-reading haze computer C for light source use manufactured by Suga Test Instruments was used to measure the amount of transmitted light diffused Td and the total amount of transmitted light Tt. The measured values were then substituted in the corresponding terms of the equation to find the haze value.

<5> Changes in fog value during durability printing

The fog value was measured after each of continuous durability print cycles of producing 200, 600, 1,000, and 2,000 printed pages. In addition, the difference between the fog value before the durability print cycles and that after the durability print cycle producing 2,000 printed pages was calculated to serve as a fog difference.

The fog value is an index that indicates, in a photoconductor or a sheet of printed paper, the degree with which the toner composition sticks to an area, to which the toner composition should not stick.

For example, in a printer employing an electrostatic latent image developing system, the toner composition can be deposited on a portion on the surface of a photoconductor, on which the toner composition should not be deposited (e.g., a portion that is not charged) because of insufficiently charged toner composition. The fog value refers to the degree with which toner composition is deposited.

The specific measurement method used to measure the fog value is as follows.

Model MICROLINE 600CL page printer manufactured by Oki Data Systems Co., Ltd. was used to produce a solid blank printed page (that is in a condition in which none of the toner composition should be deposited) and scotch mending tape (manufactured by Sumitomo 3M) was used to sample toner composition sticking to the surface of the photoconductor before image transfer. The tape was then affixed to 4200 DP 201b paper (manufactured by Xerox). For comparison, a piece of fresh tape not used for sampling toner composition was also affixed to the paper.

Model TC-6MC reflection densitometer manufactured by Tokyo Denshoku was used to measure reflection density DS of the paper, to which tape used for sampling toner composition from the surface of the photoconductor, and reflection density Do of the paper, to which fresh tape not used for sampling toner composition from the surface of the photoconductor, and the fog value was calculated using these reflection density values and the following equation.

$$\text{Fog value} = Do - Ds$$

When reflection density was measured, different filters were used for different colors of toner composition as detailed in the following: namely, filter no. 58 for the magenta toner layer, filter no. 47B for the yellow toner layer, and filter no. 25 for the cyan toner layer.

<5> Measurement results

For each of the toner compositions of Examples 1 through 5 and Comparative Examples 1 through 5, the flow-out starting temperature, ½-method temperature, and the gloss value, surface roughness Rtm, and haze value of the toner layer formed on a sheet of OHP transparencies (transparent medium) , together with an evaluation result of each, are shown in Table 4, and changes in the fog value during durability printing (fog difference) and its evaluation result are shown in Table 5. Fog value was not, however, measured for toner compositions of Comparative Examples 1 through 4.

TABLE 4

| | Flow-out starting temperature (Celsius) | ½-method temperature (Celsius) | Light transmission evaluation results | | | |
|---|---|---|---|---|---|---|
| | | | Gloss value | Rtm | Haze value | Evaluation |
| Example 1 *(A) | 105.3 | 128.7 | 45 | 2.0 | 17 | ○ |
| Example 2 *(B) | 115.8 | 144.6 | 31 | 2.1 | 20 | ○ |
| Example 3 *(C) | 96.4 | 124.4 | 45 | 2.0 | 16 | ○ |
| Example 4 *(D) | 105.7 | 132.2 | 39 | 3.2 | 22 | ○ |
| Example 5 *(E) | 100.0 | 129.5 | 70 | 1.5 | 18 | ○ |
| Comparative Example 1 *(F) | 121.3 | 146.4 | 10 | 5.6 | 70 | X |
| Comparative Example 2 *(G) | 122.9 | 153.2 | 6 | 6.9 | 70 | X |
| Comparative Example 3 *(H) | 118.9 | 147.6 | 10 | 5.7 | 70 | X |
| Comparative Example 4 *(I) | 133.8 | 170.5 | 7 | 5.7 | 66 | X |
| Comparative Example 5 *(J) | 104.8 | 129.4 | 43 | 2.3 | 26 | ○ |

*Examples 1, 2, 3, 4, and 5 correspond to toner composition A, B, C, D, and E, respectively, and Comparative Examples 1, 2, 3, 4, and 5 correspond to toner composition F, G, H, I, and J, respectively.

TABLE 5

| | Fog value after continuous durability print cycles | | | | | Difference in fog value before durability print cycles and after the print cycle producing 2,000 printed pages | Evaluation |
|---|---|---|---|---|---|---|---|
| | Before durability print cycles | After a print cycle producing 200 printed pages | After a print cycle producing 600 printed pages | After a print cycle producing 1,000 printed pages | After a print cycle producing 2,000 printed pages | | |
| Example 1 *(A) | 2.0 | 2.1 | 2.0 | 2.2 | 2.3 | 0.3 | ○ |
| Example 2 *(B) | 1.3 | 1.2 | 2.3 | 3.4 | 4.2 | 2.9 | ○ |
| Example 3 *(C) | 1.2 | 2.0 | 4.9 | 5.2 | 6.0 | 4.8 | ○ |
| Example 4 *(D) | 1.8 | 1.7 | 2.6 | 3.2 | 4.0 | 2.2 | ○ |
| Example 5 *(E) | 1.3 | 3.6 | 3.0 | 4.0 | 5.3 | 4.0 | ○ |
| Compar. Example 5 *(J) | 1.9 | 9.7 | 17.5 | 25.4 | 34.2 | 32.3 | X |

*Examples 1, 2, 3, 4, 5 and Comparative Example 5 correspond to toner composition A, B, C, D, E, and J, respectively.

Referring to Tables 4 and 5, the toner compositions of Examples 1 through 5 have a gloss value of 30 or more, Rtm of 5.0 μm or less, and a haze value of 22 or less on the toner layer produced on the sheet of OEP transparencies. That is, they offer outstanding light transmission of the toner layer.

Since the increase in the fog value after the durability print cycle producing 2,000 printed pages is 4.8 at the maximum, it has been verified that the toner compositions offer a high strength and durability. That means that there is no drop in the level of charge of the toner composition that could otherwise occur as a result of the charge controlling agent and external additive being embedded in the toner composition.

Comparative Example 1 represents a toner composition having a gel percentage of 24.3%, a flow-out starting temperature of 121.3° C., and a ½-method temperature of 146.4° C., being beyond the scope of the invention. The toner layer formed through solid printing of this toner composition on a sheet of OHP transparencies has a gloss value of 30 or less, Rtm of 5.0 μm or more, and a haze value of 70, indicating that it is inferior in light transmission.

Comparative Example 2 represents a toner composition having a gel percentage of 9.7%, a flow-out starting temperature of 122.9° C., and a ½-method temperature of 153 .2° C, being beyond the scope or the invention. The toner layer formed through solid printing of this toner composition on a sheet of OHP transparencies has a gloss value of 30 or less, Rtm of 5.0 μm or more, and a haze value of 70, indicating that it is inferior in light transmission.

Comparative Example 3 represents a toner composition having a gel percentage of 8.7% and a ½-method temperature of 147.6° C., being beyond the scope of the invention. The toner layer formed through solid printing of this toner composition on a sheet of OHP transparencies has a gloss value of 30 or less, Rtm of 5.0 μm or more, and a haze value of 70, indicating that it is inferior in light transmission.

Comparative Example 4 represents a toner composition having a gel percentage of 7.6%, a flow-out starting temperature of 133.8° C., and a ½-method temperature of 170.5° C., being beyond the scope of the invention. The toner layer formed through solid printing of this toner composition on a sheet of OHP transparencies has a gloss value of 30 or less, Rtm of 5.0 μm or more, and a haze value of 66, indicating that it is inferior in light transmission.

Comparative Example 5 represents a toner composition having a gel percentage of 0%, being beyond the scope of the invention. Noticeable about this toner composition is that there is an inordinately large increase in the fog value after the durability print cycle producing 2,000 printed pages and the toner composition is inferior in strength and durability. That is, because of insufficient strength and durability of the toner composition, the charge controlling agent and external additive are embedded inside the toner composition, which results in the level of charge of the toner composition being lowered, thus increasing the fog value by a large margin.

It is to be understood that the invention is not limited to the aforementioned embodiments, rather, various other embodiments are possible without departing from the spirit and scope of the invention.

The solvent used by the dispersion polymerization method in the manufacture of polymerized resin particles may be a mixture of one or two or more types of alcohol including, for example, methanol, ethanol, n-butanol, s-butanol, tertiary butanol, n-amyl alcohol, s-amyl alcohol, tertiary amyl alcohol, isoamyl alcohol, isobutyl alcohol, isopropyl alcohol, 2-ethylbutanol, 2-ethylhexanol, 2-octanol, n-octanol, n-decanol, cyclohexanol, n-hexanol, 2-heptanol, 3-heptanol, 3-pentanol, methylcyclohexanol, 2-methyl-2-butanol, 3-methyl-2-butanol, 3-methyl-1-butyne-3-ol, 4-methyl-2-pentanol, and 3-methyl-l-pentene-3-ol. Of all these types of alcohol, a combination of methanol and isopropyl alcohol is particularly preferable.

The organic solvents used in combination with these types of alcohol include, for example, hydrocarbon solvent such as hexane, toluene, cyclohexane, benzene, xylene, or the like; ethers such as ethyl benzyl ether, dibutyl ether, dipropyl ether, dibenzyl ether, dimethyl ether, vinyl methyl ether, vinyl ethyl ether, tetrahydrofuran, or the like; ketons such as acetaldehyde, acetone, acetophenone,di-isobutyl ketone, di-isopropyl ketone, cyclohexanone, or the like; esters such as ethyl formate, ethyl acetate, methyl acetate, ethyl stearate, methyl stearate, or the like; and water These solvents are used to adjust the SP value (solubility parameter) of the reaction system.

The dispersing agent used by the dispersion polymerization method in the manufacture of polymerized resin particles may be a mixture of one or several types of dispersing agents including, for example, polyvinyl pyrrolidone, polyvinyl alcohol, polyethylene-imine, hydroxypropyl cellulose, hydroxypropyl methyl cellulose, hydroxypropyl ethyl cellulose, polyisobutylene, polyacrylic acid, polyacrylic ester, polymethacrylic acid, polyester methacrylate, polyacrylamide, and polyvinyl acrylic ether. Of these, polyvinyl pyrrolidone or polyethylene-imine is preferable to manufacture monodisperse polymerized resin particles with a narrow particle distribution.

The monomers used by the dispersion polymerization method in the manufacture of polymerized resin particles include, for example, aromatic vinyls such as styrene, vinyltoluene, α-methylstyrene, vinyl biphenyl, vinylnaphthalene, or the like; methacrylate esters such as methacrylate methyl, methacrylate ethyl, methacrylate 2-ethylhexyl, or the like; acrylic esters such as methyl acrylate, ethyl acrylate, butyl acrylate, ethylhexyl acrylate, or the like; vinyl esters such as acrylonitrile, vinyl formate, vinyl acetate, vinyl propionate, or the like; vinyl ethers such as vinyl methyl ether, vinyl ethyl ether, or the like; methacrylic acid, acrylic acid, maleic. anhydride, and metallic salt thereof; amides such as acrylamide, methacrylamide, or the like; monomers having functional groups such as diethylaminoethyl methacrylate, diethylaminoethyl acrylate, or the like; and, monomers containing fluorine such as trifluoroethyl methacrylate, tetrafluoropropyl methacrylate, or the like.

The polymerized resin particles used as binder resin particles of the toner composition has preferably a high transparency considering an application thereof to OHP transparencies. It is also preferable that they have a high insulation performance in order to obtain good developing images. Furthermore, it is preferable that the polymerized resin particles have a high mechanical strength under room temperature so as not to be crushed inside a developing apparatus and, at the same time, soften to be fixed onto a printed medium without requiring large amounts of energy. When these aspects are taken into consideration, an ideal monomer would be a mixture of styrene and acrylic ester, or styrene and methacrylate ester.

The initiators used by the dispersion polymerization method in the manufacture of polymerized resin particles include, for example, as azo base and hydrochloride base, 2,2'-azobis (2-methyl-N-phenyl propionic amidine) dihydro chloride, 2,2'-azobis [N-(4-chlorophenyl)-2-methyl propionic amidine)] dihydro chloride, 2, 2'-azobis [N-(4-hydroxyphenyl)-2-methyl propionic amidine)] dihydro chloride, 2,2'-azobis [N-(4-aminophenyl)-2-methyl propionic amidine)] tetrahydro chloride, 2,2'-azobis [2-methyl-N-(phenylmethyl) propionic amidine) dihydro chloride, 2,2'-azobis [2-methyl-N-2-propenyl propionic amidine) dihydro chloride, 2,2'-atobis (2-methyl propionic anidine) dihydro chloride, 2,2'-azobis (N-(2-hydroxyethyl)-2-methyl propionic amidine] dihydro chloride, 2,2'-azobis (2-5-methyl-2-imidazoline-2-yl) propane] dihydro chloride, 2,2'-azobis [2-(2-imidazoline-2-yl) propane] dihydro chloride, 2,2'-azobis [2-(4,5,6,7-tetrahydro-1H-1,3-diazepyn-2-yl) propane] dihydro chloride, 2,2'-azobis [2-(3,4,5,6-tetrahydro pyridine-2-yl) propane] dihydro chloride, 2,2'-azobis [2-(5-hydroxy-3,4,5,6-tetrahydro pyridine-2-yl) propane] dihydro chloride, and 2,2'-azobis {2-[1-(2-hydroxy ethyl)-2-imidazoline-2-yl) propane] dihydro chloride.

Other azo-base initiators include 2,2'-azobisisobutyronitrile, 2,2'-azobismethylbutyronitrile, 2,2'-arobis-2-cyclopropyl propionitrile, 2,2'-azobis-4-methoxy-2,4-dimethyl valeronitrile, 1,1'-azobis cyclohexane-1-carbonitrile, 2,2'-azobis (2,4-dimethyl) valeronitrile, 2-phenylazo-4-methoxy-2,4-dimethyl valeronitrile, and 2,2'-azobis-N,N'-dimethylene isobutyl amidine.

Organic peroxide initiators include benzoyl peroxide, methyl ethyl ketone peroxide, cumene hydroperoxide, tertiary butyl hydroperoxide, cyclohexanone hydroperoxide, tertiary butyl peroxide, tertiary butyl peroxy benzoate, tertiary butyl peroxy-2-ethylhexanoate, tertiary butyl peroxy pivalate, tertiary butyl peroxy neo-decanoate, 3,5,5-trimethyl hexanol peroxide, di-isopropyl benzene hydroperoxide, lauroyl peroxide, and dicumyl peroxide.

Any one of these initiators or a mixture of a plurality thereof is used. Particularly preferable among other initiators are 2,2'-azobisisobutyronitrile and benzoyl peroxide.

The crosslinking agents used by the dispersion polymerization method in the manufacture of polymerized resin particles include, for example, divinylbenzene, divinyl biphenyl, divinyl naphthalene, ethylene glycol di-acrylate, ethylene glycol di-methacrylate, butanediol di-acrylate, butanediol di-methacrylate, trimethylolpropane tri-acrylate, trimethylolpropane tri-methacrylate, pentaerythritol tri-acrylate, and pentaerythritol tri-methacrylate.

Considering that a mixture of styrene and acrylic ester, or a mixture of styrene and methacrylate ester, is used as the monomer when polymerizing resin particles, it is particularly preferable that divinylbenzene, divinyl biphenyl, ethylene glycol di-acrylate, and ethylene glycol di-methacrylate be used as the crosslinking agent among others.

Cleaning of polymerized resin particles recovered in the manufacture of polymerized resin particles can be accomplished by dispersing the polymerized resin particles in a solvent of alcohol or water and then filtering them. Repeating this cleaning procedure one to five times will allow polymerized resin particles with no impurities left to be obtained.

What is claimed is:

1. A toner composition containing at least one kind of binder resin, wherein:

a gel percentage of the toner composition ranges between 2 and 15%; and, a flow-out starting-temperature of the toner composition ranges between 80 and 120° C.

2. The toner composition according to claim 1, further comprising at least one kind of dye.

3. The toner composition according to claim 1, wherein the shape of the toner composition is spherical.

4. The toner composition according to claim 1, wherein the toner composition is used as dry toner for electrostatic latent image development.

5. The toner composition according to claim 1, wherein a dispersion polymerization method is used to manufacture particles comprising the binder resin.

6. The toner composition according to claim 1, wherein a toner layer formed through solid printing and fusing of the toner composition on a transparent medium has a gloss value of 30 or more and a surface roughness Rtm of 5 $\mu$m or less.

7. The toner composition according to claim 2, wherein the shape of the toner composition is spherical.

8. A toner composition containing at least one kind of binder resin, wherein:

a gel percentage of the toner composition ranges between 2 and 15%; and, a ½-method temperature of the toner composition ranges between 100 and 145° C.

9. The toner composition according to claim 8, further comprising at least one kind of dye.

10. The toner composition according to claim 8, wherein the shape of the toner composition is spherical.

11. The toner composition according to claim 8, wherein the toner composition is used as dry toner for electrostatic latent image development.

12. The toner composition according to claim 8, wherein a dispersion polymerization method is used to manufacture particles comprising the binder resin.

13. The toner composition according to claim 8, wherein a toner layer formed through solid printing and fusing of the toner composition on a transparent medium has a gloss value of 30 or more and a surface roughness Rtm of 5 $\mu$m or less.

14. The toner composition according to claim 9, wherein the shape of the toner composition is spherical.

15. A toner composition containing at least one kind of binder resin, wherein:

a gel percentage of the toner composition ranges between 2 and 15%;

a flow-out starting temperature of the toner composition ranges between 80 and 120° C.; and, a ½-method temperature of the toner composition ranges between 100 and 145° C.

16. The toner composition according to claim 15, further comprising at least one kind of dye.

17. The toner composition according to claim 15, wherein the shape of the toner composition is spherical.

18. The toner composition according to claim 15, wherein the toner composition is used as dry toner for electrostatic latent image development.

19. The toner composition according to claim 15, wherein a dispersion polymerization method is used to manufacture particles comprising the binder resin.

20. The toner composition according to claim 15, wherein a toner layer formed through solid printing and fusing of the toner composition on a transparent medium has a gloss value of 30 or more and a surface roughness Rtm of 5 $\mu$m or less.

21. The toner composition according to claim 16 wherein the shape of the toner composition is spherical.

22. The toner composition according to claim 1, wherein the gel percentage of the toner composition is defined as the ratio between A, an initial amount of a solid, and B, an amount of the solid that is not dissolved in a solvent, wherein the ratio is determined by the following formula:

$$B/A \times 100.$$

23. The toner composition according to claim 2, wherein the at least one kind of dye is added after binder resin is polymerized.

24. The toner composition according to claim 8, wherein the gel percentage of the toner composition is defined as the ratio between A, an initial amount of a solid, and B, an amount of the solid that is not dissolved in a solvent, wherein the ratio is determined by the following formula:

$$B/A \times 100.$$

25. The toner composition according to claim 9, wherein the at least one kind of dye is added after binder resin is polymerized.

26. The toner composition according to claim 15, wherein the gel percentage of the toner composition is defined as the ratio between A, an initial amount of a solid, and B, an amount of the solid that is not dissolved in a solvent, wherein the ratio is determined by the following formula:

$$B/A \times 100.$$

27. The toner composition according to claim 16, wherein the at least one kind of dye is added after binder resin is polymerized.

* * * * *